US005621998A

United States Patent [19]

Norgaard

[11] Patent Number: 5,621,998

[45] Date of Patent: Apr. 22, 1997

[54] SPEED LOADER

[76] Inventor: Charles Norgaard, 28400 NE. 91 Ave., Battle Ground, Wash. 98604

[21] Appl. No.: 551,524

[22] Filed: Nov. 1, 1995

[51] Int. Cl.[6] ..... F41A 9/85

[52] U.S. Cl. ..... 42/89

[58] Field of Search ..... 42/89, 87, 88

[56] References Cited

U.S. PATENT DOCUMENTS

| | | | |
|---|---|---|---|
| 667,351 | 2/1901 | Wagner | 42/89 |
| 1,202,343 | 10/1916 | Wesson et al. | 42/89 |
| 3,213,559 | 10/1965 | Matich | 42/89 |
| 3,667,146 | 6/1972 | Dupouy | 42/89 |
| 3,785,077 | 1/1974 | Price | 42/89 |
| 4,402,153 | 9/1983 | Peter et al. | 42/89 |
| 4,507,889 | 4/1985 | Allen | 42/89 |
| 4,535,558 | 8/1985 | Benesh | 42/89 |

*Primary Examiner*—Michael J. Carone
*Assistant Examiner*—Christopher K. Montgomery
*Attorney, Agent, or Firm*—Smith-Hill and Bedell

[57] ABSTRACT

A speed loader for loading a plurality of cartridges having shells into respective chambers of a revolver cylinder comprises a sheet form piece of resilient material formed with six substantially circular bores of diameter slightly less than the caliber of the shells. The cartridges can be fitted in the bores respectively and will be held in the bores by tension in the resilient material and frictional engagement between the resilient material and the shells of the cartridges. The six bores are arranged in two groups of three. The bores of the first group have their centers lying on a first arc of radius substantially equal to the radius of the circle on which the centers of the chambers lie, and the centers of the two outer bores are angularly spaced along the arc at approximately 60° from the center of the inner bore. The bores of the second group have their centers lying on a second arc of the same radius as the first arc and the centers of the two outer bores are angularly spaced along the arc at approximately 60° from the center of the inner bore. A line from the center of the inner bore of the first group through the center of curvature of the first arc and a line from the inner bore of the second group through the center of curvature of the second arc are in diverging relationship.

6 Claims, 1 Drawing Sheet

SPEED LOADER

BACKGROUND OF THE INVENTION

This invention relates to a speed loader for loading a set of six cartridges of predetermined caliber into respective chambers of a revolver.

A revolver has a cylinder that defines five or six chambers for receiving respective cartridges. Each cartridge comprises a shell or casing having a rim at one end and a mouth at its opposite end, a charge of explosive in the shell, and a bullet fitted in the mouth of the shell. The cartridge is fitted in one of the chambers of the revolver cylinder, and the cylinder is rotated to align the cylinder with the barrel of the revolver. When the trigger is pulled, the firing pin strikes the shell, the explosive is ignited, and the bullet is propelled from the shell and leaves the revolver through its barrel.

Revolver sport shooting is a popular competitive sport. One type of revolver shooting competition involves shooting numerous rounds of ammunition at a target. The number of rounds exceeds the number of cartridges that can be held in the chamber of the revolver cylinder, and accordingly the competitor must eject the shells of the spent cartridges from the cylinder and load fresh cartridges in order to continue shooting and complete the competition. The type of competition teats not only marksmanship, by applying a score to the accuracy with which each bullet strikes its target, but also speed, by applying a score to the rapidity with which the shots are fired. In order to maximize the speed compound of the overall score, it is desirable to be able to minimize the time spent in reloading the revolver after each group of five or six cartridges has been fired. Accordingly, several devices have been proposed for facilitating rapid loading of cartridges into the chambers of a revolver.

SUMMARY OF THE INVENTION

In accordance the invention there is provided a speed loader for loading a plurality of cartridges having shells of predetermined caliber into respective chambers of a revolver cylinder, centers of the chambers being on a circle of predetermined radius, said speed loader comprising a sheet form piece of resilient material formed with six substantially circular bores of diameter slightly less than said predetermined caliber, whereby the cartridges can be fitted in the bores respectively and will be held in the bores by tension in the resilient material and frictional engagement between the resilient material and the shells of the cartridges, the six bores being arranged in a first group of an inner bore and two outer bores and a second group of an inner bore and two outer bores, the bores of the first group having their centers lying on a first arc of radius substantially equal to said predetermined radius and the centers of the two outer bores being angularly spaced along said arc at approximately 60° from the center of the inner bore, and the bores of the second group having their centers lying on a second arc of radius substantially equal to said predetermined radius and the centers of the two outer bores being angularly spaced along said arc at approximately 60° from the center of the inner bore, and wherein a line from the center of the inner bore of the first group through the center of curvature of the first arc and a line from the inner bore of the second group through the center of curvature of the second arc are in diverging relationship.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
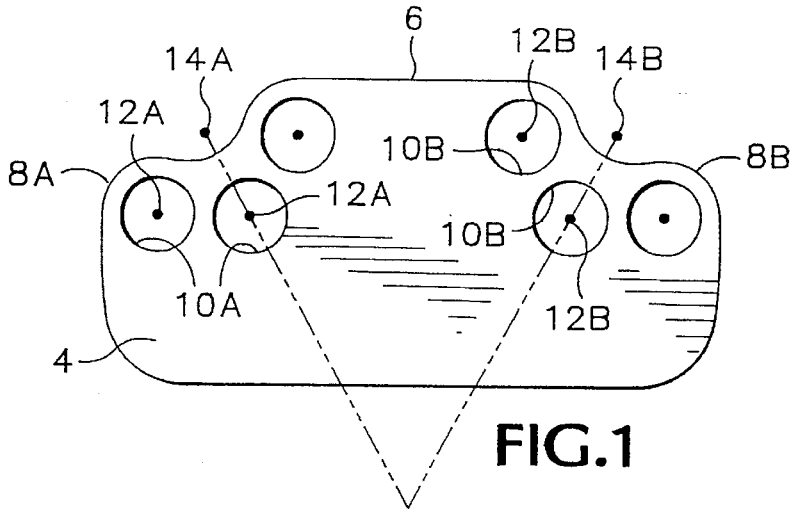
FIG. 1 is a plan view of a speed loader embodying the present invention.
Figure 2:
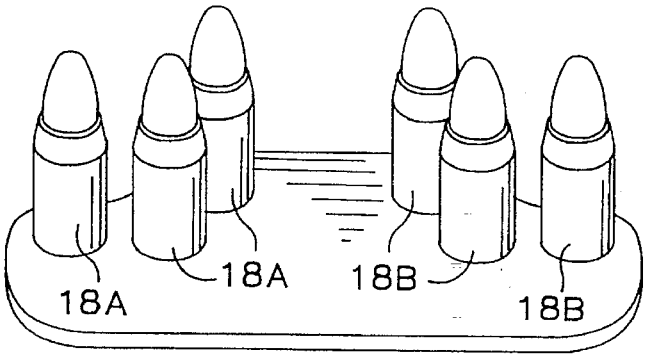
FIG. 2 is a perspective view of the speed loader when charged with six cartridges.

The speed loader that is shown in the drawings is designed for use with a revolver that shoots .38 standard or .357 magnum ammunition. The diameter of the shell of a .38 standard or .357 magnum revolver cartridge is in each case about .38 inches. A revolver for shooting such ammunition has a cylinder formed with five or six equiangularly spaced chambers. The centers of the chambers lie on a circle and the diameter of this circle depends upon the model of revolver.

The illustrated speed loader comprises a generally rectangular sheet form piece of elastically resilient material, such as a neoprene rubber. The speed loader is in two parts, namely a gripping part 4, to be held in the hand of a user, and a cartridge receiving part 6. The cartridge receiving part 6 has two end regions 8A and 8B, and the two end regions are formed with respective groups of three circular bores 10A and 10B, each of a diameter slightly less than the caliber of the cartridges that are to be loaded using the speed loader. The two groups of bores 10A, 10B are symmetrically disposed at the two opposite ends of the speed loader. The center 12A of each bore 10A lies on an arc that has a radius of approximately 0.9 inches and whose center 14A is outside the speed loader, and the centers 12B of the bores 10B are similarly placed about a point 14B. The two outer bores in each group are spaced at approximately 60° from the inner bore. Each group of bores is at a corner region of the speed loader, with the arc on which the centers of the bores lie being concave toward the corner. The two corner regions at which the groups of bores are respectively located are recessed, for a purpose that will be described below, and the line from the center of the inner bore of the bores 10A through the center 14A of the arc at the corner region 8A is in diverging relationship with the line from the center of the inner bore of the bores 10B through the center 14B of the arc at the corner region 8B.

Figure 3:
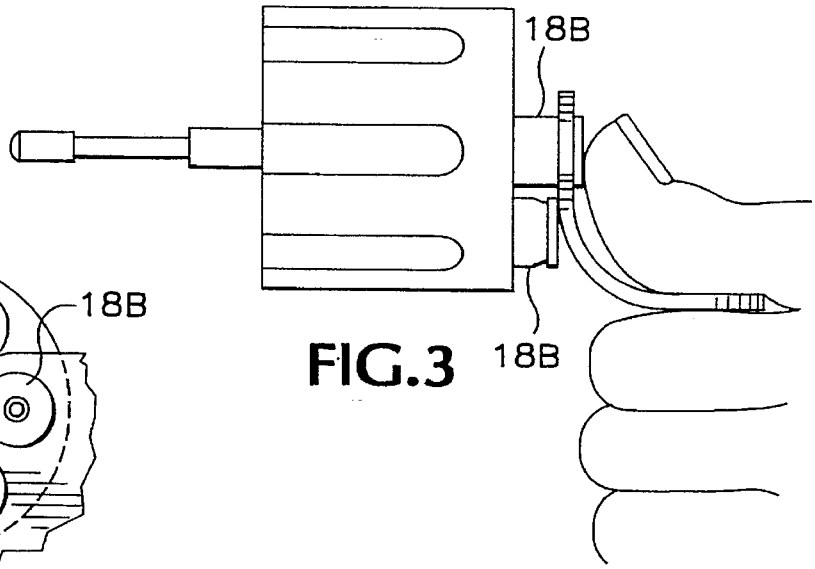
FIG. 3 is a side view illustrating use of the speed loader for loading cartridges into the chambers of a revolver cylinder.

In the event that the speed loader is to be used with a revolver having six chambers, the speed loader is charged in advance of a revolver shooting competition by fitting six cartridges 18 in the six bores 10 respectively, and the charged speed loader is placed at a location where it will be conveniently to hand when the user needs to reload the revolver. In order to reload the revolver, the shells of the spent cartridges are ejected from the respective chambers in the usual fashion, and the user takes the speed loader and holds it with the gripping part in the hand. The user positions the speed loader to present a first group of three cartridges, e.g. the cartridges 18B, to three of the revolver chambers and inserts the cartridges in the respective chambers. The speed loader is then captive between the rims of the cartridge and the revolver cylinder. However, because the speed loader is made of elastic material, the user can readily remove the speed loader from the three cartridges 18B that have been placed in the respective chambers, while leaving the cartridges behind in the respective chambers, by peeling the speed loader over the rims of the cartridges as shown in FIG. 3. The cartridges then fall fully into the respective chambers, it being understood that although the cylinder is shown in a horizontal disposition in FIG. 3, it would normally be oriented nearly vertical during a loading operation. The user then turns the cylinder to place the remaining three chambers at a convenient position and inserts the second group of three cartridges 18A in the remaining three chambers. As before, the speed loader is captive between the rims of the cartridges and the revolver cylinder, but can be removed by peeling it back over the rims of the cartridges, to release the cartridges and allow them to fall fully into the respective chambers. The revolver can then be closed and fired.

Because the arcs on which the groups of bores 10A, 10B lie are concave toward the respective corner regions of the speed loader, when either group of cartridges is being presented to the chambers of the revolver cylinder, the major part of the area of the speed loader extends away from the cylinder and there is no interference between the speed loader and the revolver.

The speed loader that is described above can be used with many different models of revolver designed for shooting .38 standard or .357 magnum ammunition, even though the circle on which the centers of the chambers lie is not the same from model to model, because the variations are sufficiently small that they can be accommodated by the elastic nature of the speed loader.

Figure 4:
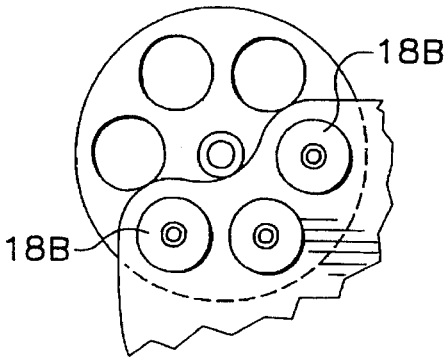
FIG. 4 is a partial end view corresponding to FIG. 3.

It has been mentioned above that the corner regions 8 of the speed loader are recessed as shown in FIG. 1. This ensures that the center of the arc on which the bores lie is outside the outer periphery of the speed loader. Therefore, when the speed loader is being positioned for inserting the cartridges, the center of the revolver cylinder is visible, as shown in FIG. 4, which facilitates positioning of the speed loader.

It will be seen that all convex edges of the speed loader are curved. This facilitates handling of the speed loader and minimizes the possibility of its snagging, for example on a user's clothing or on a pouch in which the gripping portion of the speed loader may be installed.

In order to load a revolver having five chambers in its cylinder, three cartridges would be installed in one group of bores and two cartridges would be installed in two adjacent bores of the other group. Even though the chambers of such a revolver are spaced at 72° instead of 60°, the elastic nature of the speed loader allows it to be used.

It will be appreciated that the invention is not restricted to the particular embodiment that has been described, and that variations may be made therein without departing from the scope of the invention as defined in the appended claims and equivalents thereof. For example, the invention is not restricted to use with revolvers designed for shooting .38 standard or .357 magnum ammunition, and by selecting appropriate dimensions for the speed loader, it may be adapted to other calibers.

I claim:

1. A speed loader for loading a plurality of cartridges having shells of predetermined caliber into respective chambers of a revolver cylinder, centers of the chambers being on a circle of predetermined radius, said speed loader comprising a sheet form piece of resilient material formed with six substantially circular bores of diameter slightly less than said predetermined caliber, whereby the cartridges can be fitted in the bores respectively and will be held in the bores by tension in the resilient material and frictional engagement between the resilient material and the shells of the cartridges, the six bores being arranged in a first group of an inner bore and two outer bores and a second group of an inner bore and two outer bores, the bores of the first group having their centers lying on a first arc of radius substantially equal to said predetermined radius and the centers of the two outer bores being angularly spaced along said arc at approximately 60° from the center of the inner bore, and the bores of the second group having their centers lying on a second arc of radius substantially equal to said predetermined radius and the centers of the two outer bores being angularly spaced along said arc at approximately 60° from the center of the inner bore, and wherein a line from the center of the inner bore of the first group through the center of curvature of the first arc and a line from the inner bore of the second group through the center of curvature of the second arc are in diverging relationship.

2. A speed loader according to claim 1, wherein the sheet form piece of resilient material comprises an elongate gripping portion having two opposite ends, for gripping the speed loader in a user's hand, and a cartridge receiving portion that extends along an edge of the gripping portion, and wherein the first group of three bores is formed in the cartridge receiving portion at one end thereof and the second group of three bores is formed in the cartridge receiving portion at an opposite end thereof.

3. A speed loader according to claim 2, wherein the sheet form piece of resilient material has a peripheral shape such that the centers of said first and second arcs are outside the sheet form piece of resilient material.

4. A speed loader according to claim 1, wherein the first group of three bores is formed in the sheet form piece of resilient material at one end thereof and the second group of three bores is formed in the sheet form piece of resilient material at an opposite end thereof, and the sheet form piece of resilient material has a peripheral shape such that the centers of said first and second arcs are outside the sheet form piece of resilient material.

5. A speed loader according to claim 1, wherein the sheet form piece of resilient material has a first edge and a second edge and projections of the first and second edges meet approximately at right angles at a point that is outside the sheet form piece of resilient material, the first group of three bores is formed in the sheet form piece of resilient material between said first and second edges, and the sheet form piece of resilient material has a peripheral shape between said first and second edges that is concave toward said point.

6. A speed loader according to claim 5, wherein the sheet form piece of resilient material has a peripheral shape such that the center of said first arc is outside the sheet form piece of resilient material.

* * * * *